US009920448B2

(12) United States Patent
McHugh et al.

(10) Patent No.: US 9,920,448 B2
(45) Date of Patent: Mar. 20, 2018

(54) INERT ANODE ELECTROPLATING PROCESSOR AND REPLENISHER WITH ANIONIC MEMBRANES

(71) Applicant: APPLIED Materials, Inc., Santa Clara, CA (US)

(72) Inventors: Paul R. McHugh, Kalispell, MT (US); Gregory J. Wilson, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 278 days.

(21) Appl. No.: 14/944,585

(22) Filed: Nov. 18, 2015

(65) Prior Publication Data

US 2017/0137959 A1 May 18, 2017

(51) Int. Cl.

| | |
|---|---|
| ***C25D 3/38*** | (2006.01) |
| ***C25D 17/00*** | (2006.01) |
| ***C25D 17/10*** | (2006.01) |
| ***C25D 21/18*** | (2006.01) |

(52) U.S. Cl.

CPC ..... *C25D 21/18* (2013.01); *C25D 17/001* (2013.01); *C25D 17/002* (2013.01); *C25D 17/10* (2013.01); *C25D 3/38* (2013.01)

(58) Field of Classification Search

CPC ..... C25D 3/38; C25D 17/001; C25D 17/002; C25D 17/10; C25D 21/18

See application file for complete search history.

(56) References Cited

U.S. PATENT DOCUMENTS

| | | | |
|---|---|---|---|
| 6,878,258 | B2 | 4/2005 | Kovarsky |
| 8,123,926 | B2 | 2/2012 | Baskaran et al. |
| 8,496,789 | B2 | 7/2013 | McHugh et al. |
| 8,496,790 | B2 | 7/2013 | Wilson et al. |
| 8,808,888 | B2 | 8/2014 | Wilson et al. |
| 8,961,771 | B2 | 2/2015 | Baskaran et al. |
| 9,005,409 | B2 | 4/2015 | Guarnaccia et al. |

(Continued)

FOREIGN PATENT DOCUMENTS

| | | | | |
|---|---|---|---|---|
| JP | 2007002274 A | | 1/2007 | |
| WO | WO-0192604 A2 | * | 12/2001 | ..... C25D 21/14 |

OTHER PUBLICATIONS

International Application Division, Korean Intellectual Property Office, "The International Search Report and the Written Opinion of the International Searching Authority", International application No. PCT/US2016/061415 dated Feb. 27, 2017.

*Primary Examiner* — Ciel P Thomas

(74) *Attorney, Agent, or Firm* — Perkins Coie LLP; Kenneth H. Ohriner

(57) ABSTRACT

An electroplating system includes a processor has a vessel having a first or upper compartment and a second or lower compartment containing catholyte and anolyte, respectively, with an processor anionic membrane between them. An inert anode is located in the second compartment. A replenisher is connected to the vessel via catholyte return and supply lines and anolyte return and supply lines, to circulate catholyte and anolyte through compartments in the replenisher separated by a replenisher anionic membrane. The replenisher adds metal ions into the catholyte by moving ions from a bulk metal source, and moves anions from the anolyte through the anionic membrane and into the catholyte. Concentrations or metal ions and anions in the catholyte and the anolyte remain balanced.

20 Claims, 2 Drawing Sheets

(56) References Cited

U.S. PATENT DOCUMENTS

| | | | |
|---|---|---|---|
| 9,017,528 | B2 | 4/2015 | Papapanayiotou |
| 2001/0020583 | A1 | 9/2001 | Woodruff et al. |
| 2005/0016857 | A1 | 1/2005 | Kovarsky et al. |
| 2006/0157355 | A1 | 7/2006 | Baskaran et al. |
| 2006/0189129 | A1 | 8/2006 | Baskaran et al. |
| 2007/0261964 | A1 | 11/2007 | Wilson et al. |
| 2012/0052347 | A1 | 3/2012 | Wilson et al. |
| 2012/0118729 | A1* | 5/2012 | Liang ..... B01D 61/48 204/267 |
| 2012/0138471 | A1 | 6/2012 | Mayer et al. |
| 2012/0298502 | A1 | 11/2012 | Papapanayiotou et al. |
| 2012/0298504 | A1 | 11/2012 | Guamaccia et al. |
| 2014/0183049 | A1 | 7/2014 | Mayer et al. |
| 2015/0008119 | A1 | 1/2015 | Papapanayiotou et al. |
| 2015/0008133 | A1* | 1/2015 | Papapanayiotou .... C25D 21/14 205/84 |
| 2015/0122658 | A1 | 5/2015 | Kim et al. |

* cited by examiner

INERT ANODE ELECTROPLATING PROCESSOR AND REPLENISHER WITH ANIONIC MEMBRANES

BACKGROUND OF THE INVENTION

Manufacture of semiconductor integrated circuits and other micro-scale devices typically requires formation of multiple metal layers on a wafer or other substrate. By electroplating metals layers in combination with other steps, patterned metal layers forming the micro-scale devices are created.

Electroplating is performed in an electroplating processor with the device side of the wafer in a bath of liquid electrolyte in a vessel, and with electrical contacts on a contact ring touching a conductive seed layer on the wafer surface. Electrical current is passed through the electrolyte and the conductive layer. Metal ions in the electrolyte plate out onto the wafer, creating a metal layer on the wafer.

Electroplating processors typically have consumable anodes, which are beneficial for bath stability and cost of ownership. For example, it is common to use copper consumable anodes when plating copper. The copper ions moving out of the plating bath to form the plated copper layer on the wafer are replenished by copper ions coming off of the anodes, thus maintaining the copper ion concentration in the plating bath. This is a cost effective way to maintain the concentration of metal ions in the bath compared to replacing the electrolyte bath. However, using consumable anodes requires a relatively complex and costly design to allow the consumable anodes to be periodically replaced. If the anodes are replaced through the top of the chamber, then the electric-field shaping hardware is disturbed requiring re-checking the performance of the chamber. If the anodes are replaced from the bottom of the chamber, then extra complication is added to the chamber body to easily remove the lower section of the chamber and add reliable seals.

Even more complexity is added when consumable anodes are combined with a membrane (for example a cation membrane) to avoid degrading the electrolyte, or oxidizing the consumable anodes during idle state operation, and for other reasons. Cationic membranes allow some metal ions to pass, which lowers the efficiency of the replenishment system and may require an extra compartment and electrolyte to offset loss of metal ions through the cationic membrane.

Electroplating processors using inert anodes have been proposed as an alternative to using a consumable anode. An inert anode processor may reduce complexity, cost, and maintenance. However, use of inert anodes has led to other disadvantages, especially related to maintaining the metal ion concentration in a cost effective manner compared to consumable anodes, and the generation of gas at the inert anode which can cause defects on the wafer. Accordingly, engineering challenges remain to providing an inert anode electroplating processor.

SUMMARY OF THE INVENTION

In one aspect, an electroplating processor has a vessel having a first or upper processor compartment and a second or lower processor compartment with a processor anionic membrane between them. Catholyte (a first electrolyte liquid) is provided in the upper compartment above the processor anionic membrane. Anolyte (a second electrolyte liquid) is provided in the lower compartment below the processor anionic membrane and in contact with the processor anionic membrane. At least one inert anode is located in the second compartment in contact with the anolyte. A head holds a wafer in contact with the catholyte. The wafer is connected to a cathode, and the inert anode is connected to an anode, of a power supply.

A replenisher is connected to the vessel via catholyte return and supply lines and anolyte return and supply lines, to circulate catholyte and anolyte through first and second replenisher compartments in the replenisher separated by an anionic membrane. The replenisher adds metal ions into the catholyte by moving ions from a bulk metal source, such as copper pellets, into the catholyte in the first replenisher compartment. Simultaneously, anions, such as sulfate ions in the case of plating copper, move from the anolyte in the second replenisher compartment, through the anionic membrane, and into the catholyte in the first replenisher compartment. Ion concentrations in the catholyte and in the anolyte in the processor remain balanced.

DETAILED DESCRIPTION OF THE DRAWINGS

Figure 1:
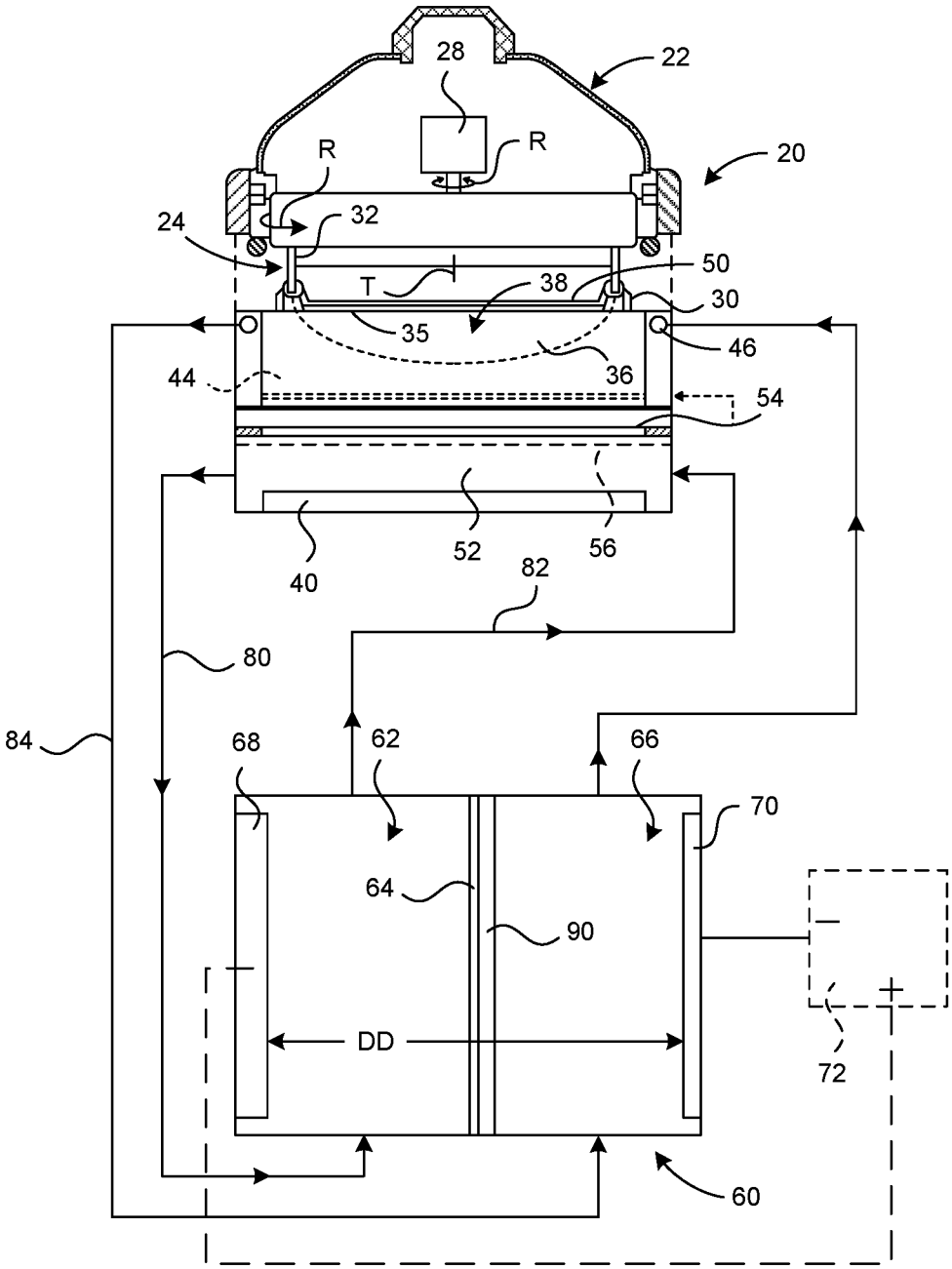
FIG. 1 is a schematic drawing of an electroplating processing system using inert anodes.

In FIG. 1, an electroplating processor 20 has a rotor 24 in a head 22 for holding a wafer 50. The wafer 50 is at or near horizontal, with the device side of the wafer 50 face-down. The rotor 24 has a contact ring 30 which may move vertically to engage contact fingers 35 on the contact ring 30 onto the down facing surface of a wafer 50. The contact fingers 35 are connected to a negative voltage source during electroplating. A bellows 32 may be used to seal internal components of the head 22. A motor 28 in the head rotates the wafer 50 held in the contact ring 30 during electroplating.

The electroplating processor 20 may alternatively have various other types of head 22. For example the head 22 may operate with a wafer 50 held in a chuck rather than handling the wafer 50 directly, or the rotor and motor may be omitted with the wafer held stationery during electroplating. In some applications, a seal on the contact ring presses against the edge of the wafer 50 to seal the contact fingers 35 away from the catholyte during processing.

During processing, the head 22 is positioned over an electroplating vessel 38 of the electroplating processor 20. The vessel 38 is divided by an processor anionic membrane 54 into a first or upper processor compartment 36 above a second or lower processor compartment 52. A di-electric material membrane support 56 may be provided below, or above and below, the processor anionic membrane 54 to better hold the processor anionic membrane 54 in place.

The first processor compartment 36 is filled with a first electrolyte referred to as catholyte, with the catholyte in contact with the top surface of the processor anionic membrane 54. The second processor compartment 52 is filled with a second electrolyte referred to as anolyte, which is in contact with the bottom surface of the processor anionic membrane 54. One or more inert anodes 40 are provided in the vessel 38 in the lower compartment 52. A di-electric material field shaping element 44 is provided in the upper compartment 36 to shape the electric field in the catholyte during processing. A current thief electrode 46 near the top of the upper compartment 36 is connected to a second cathode current source which is selected to influence the electric field around the perimeter of the wafer 50.

Figure 2:
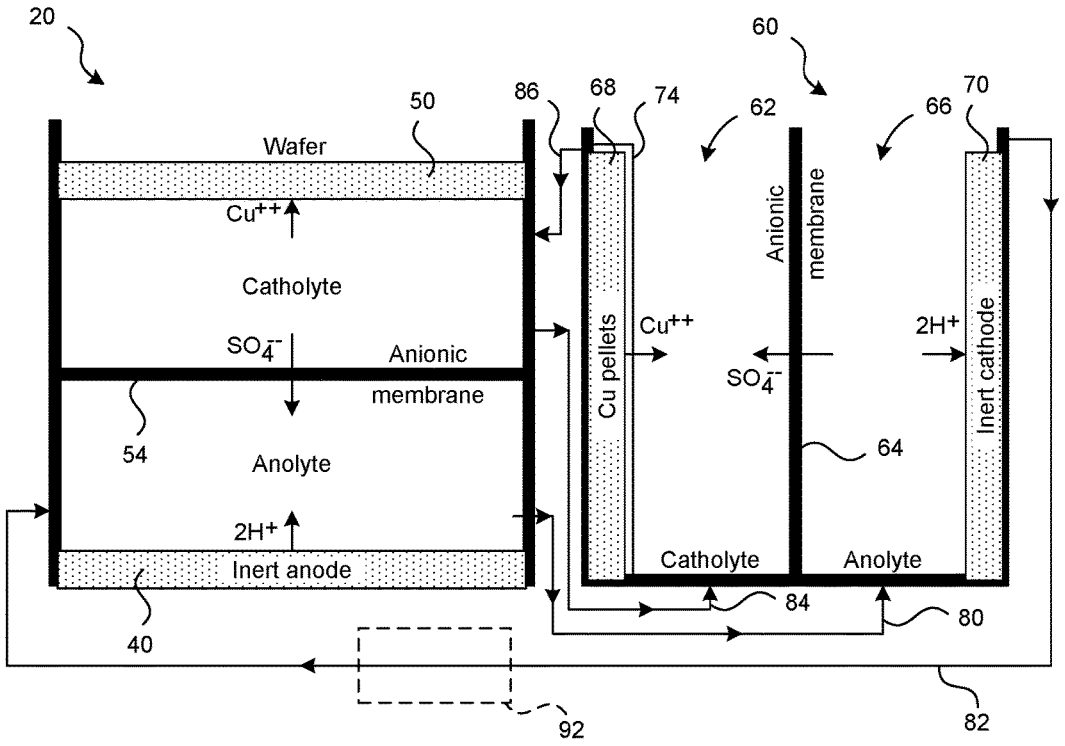
FIG. 2 is a diagram of the ionic species transport occurring during operation of the system shown in FIG. 1.

Referring now to FIGS. 1 and 2, a replenisher 60 has a first replenisher compartment 62 separated from a second replenisher compartment 66 via a replenisher anionic membrane 64. The replenisher anionic membrane 64 may be the same membrane material as the processor anionic membrane 54, although the replenisher anionic membrane 64 is substantially vertical while the processor anionic membrane 54 is horizontal or substantially horizontal, i.e., within 20 degrees of vertical and horizontal, respectively. The replenisher anionic membrane 64 may be attached to or supported by a di-electric material flow screen 90.

The catholyte in the first processor compartment 36 circulates through the first replenisher compartment 62 via supply and return lines 80 and 82. The anolyte in the second processor compartment 52 circulates through the second replenisher compartment 66 via supply and return lines 84 and 86. The supply and return lines may connect to one or more intermediate pumps, filters, tanks or heaters. Tanks 92 may be provided to hold replenished anolyte and catholyte, with multiple electroplating processors 20 supplied from the tanks 92 rather than directly from the replenisher 60.

A source of bulk metal 68, such as copper pellets, is provided in the first replenisher compartment 62. The bulk metal 68 may be contained within a di-electric material holder 74 having perforated walls or made as an open matrix or screen, so that the bulk metal 68 is held in place while also exposed to the catholyte in the first replenisher compartment 62. The holder 74 generally holds the bulk metal 68 in a relatively thin layer, to increase the surface area of the bulk metal exposed to the catholyte. The holder 74 may be attached to a vertical side wall of the first replenisher compartment 62, opposite from the replenisher anionic membrane 64.

An inert cathode 70 is provided in the second replenisher compartment 66. Typically the inert cathode 70 is a metal plate or wire mesh, for example a platinum clad wire mesh or plate. The inert cathode may be attached to a vertical side wall of the second replenisher compartment 66, opposite from the replenisher anionic membrane 64. The bulk metal 68 is electrically connected to an anode current source of a power supply 72. The inert cathode 70 is electrically connected to a cathode current source of the power supply 72.

Multiple electroplating processors 20 may be provided in columns within an electroplating system, with one or more robots moving wafers in the system. A single replenisher 60 may be used to replenish the catholyte in multiple electroplating processors 20. The power supply 72 connected to the replenisher 60 is separate from, or separately controllable from, the power supply connected to the processors 20.

In use for electroplating copper, for example, the catholyte includes copper sulfate and water, and the bulk metal 68 is copper pellets. The head 22 is moved to place a wafer 50, or the device side of the wafer 50, into contact with the catholyte in the upper compartment 36 of the vessel 38. Electric current flows from the inert anode 40 to the wafer 50 causing copper ions in the catholyte to plate out onto the wafer 50. Water at the inert anode is converted into oxygen gas and hydrogen ions.

Sulfate ions move through the processor anionic membrane 54 from the catholyte in the first processor compartment 36 into the anolyte in the second processor compartment 52. To maintain the concentration of copper ions in the catholyte, the catholyte is circulated through the first replenisher compartment 62. To avoid a buildup of sulfate ions in the anolyte, the anolyte is circulated through the second replenisher compartment 66. Within the replenisher 60, electric current flows from the bulk metal through the catholyte, the replenisher anionic membrane 64 and the anolyte to the inert cathode, via power supply 72. Copper ions from the copper pellets, and sulfate ions from the anolyte, are replaced into the catholyte. As a result, the copper and sulfate ions in catholyte and in the anolyte remain balanced during processing.

As the inert cathode 70 is vertical, gas bubbles generated at the inert cathode 70 tends to rise to the top of the second replenisher compartment 66 and are removed. If necessary, the replenisher 60 may be temporarily disconnected from the processors 20, or turned off, e.g., for maintenance, while the processors continue to operate, as the metal ion and anion concentrations change gradually.

With a single replenisher 60 connected to e.g., 10 processors, the power requirements of the replenisher 60 may be significant. The replenisher 60 may be designed to minimize the spacing between the bulk metal 68 and the inert cathode 70, to reduce the voltage drop between them, which in turn reduces the power consumption of the replenisher 60. For example, with processors 20 for 300 mm diameter wafers, the processor anionic membrane 54 has a diameter nominally larger than 300 mm. The replenisher anionic membrane 64 may have a surface area 100% to 300% larger than the surface area of the processor anionic membrane 54. The dimension DD between the bulk metal 68 and the inert cathode 70 may be e.g., 10 to 25 cm, with the bulk metal 68 and/or the inert cathode 70 having a height of 150% to 300% of DD.

Figure 3:
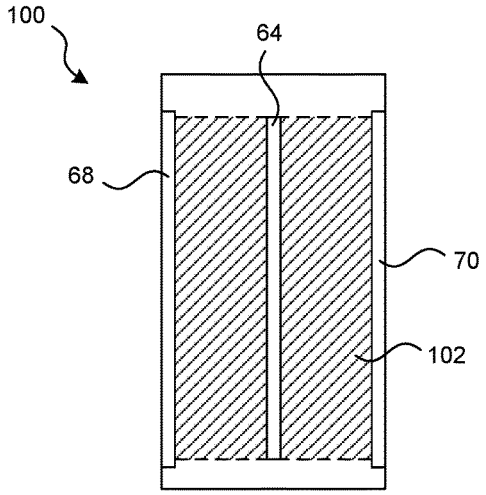
FIG. 3 is a schematic diagram of an alternative replenisher for use in the system shown in FIG. 1.

In an alternative design shown in FIG. 3, a replenisher 100 may be provided with a di-electric material flow screen 102 sandwiched between the bulk metal 68 and the inert cathode 70, with the replenisher anionic membrane 64 built into or embedded in the flow screen 102. In this design the flow screen 102 occupies the entire volume between the bulk metal 68 and the inert cathode 70, so that there is no open catholyte or anolyte volume in the replenisher 60. The flow screen 102 may be in contact with the bulk metal 68, or the holder 74, or the inert cathode 70, or be slightly spaced apart from holder 74 or the inert cathode 70 by a small gap of up to 5 mm. The flow screen 102 may have 70% to 95% open area. The bulk metal 68, flow screen 102, replenisher anionic membrane 64 and the inert cathode 70 may be combined into a single integral unit, which may be quickly and easily replaced as a unit.

In contrast to other replenishment techniques, the present system and method uses only a single membrane in the processor and in the replenisher, a single catholyte, and a single anolyte, with no additional intermediate electrolytes or compartments needed. Hence, the replenisher requires only two compartments. As the anionic membranes prevent metal ions from passing, the system maintains a high level of efficiency. Although explained above in an example for electroplating copper, the present system and method may also be used to electroplate other metals as well.

Thus, novel systems and methods have been shown and described. Various changes and substitutions may of course be made without departing from the spirit and scope of the invention. The invention, therefore, should not be limited except by the following claims and their equivalents.

The invention claimed is:

1. An electroplating system comprising:

a processor having an electroplating vessel having first and second processor compartments, with the second processor compartment containing anolyte and the first processor compartment containing catholyte, with the anolyte separated from the catholyte by a processor anionic membrane, and the catholyte including metal ions;

at least one inert anode in contact with the anolyte in the second processor compartment;

a head for holding a wafer with a conductive seed layer in contact with the catholyte;

a contact ring on the head having electrical contacts for making electrical contact to the conductive seed layer; and a replenisher including:

a first replenisher compartment connected to the first processor compartment via first supply and return lines, with the first replenisher compartment containing the catholyte and bulk metal;

a second replenisher compartment connected to the second processor compartment via second supply and return lines, with the second replenisher compartment containing the anolyte and an inert cathode;

a replenisher anionic membrane separating the catholyte in the first replenisher compartment from the anolyte in the second replenisher compartment.

2. The system of claim 1 with the inert cathode comprising a platinum clad wire mesh or plate.

3. The system of claim 1 with the processor anionic membrane horizontal and the replenisher anionic membrane vertical.

4. The system of claim 1 wherein the bulk metal comprises copper and the anolyte comprises sulfate.

5. The system of claim 1 wherein the replenisher has only two replenisher compartments.

6. The system of claim 1 wherein the replenisher holding only two electrolytes.

7. The system of claim 1 further including a flow screen in the replenisher supporting the replenisher anionic membrane.

8. The system of claim 7 with the replenisher anionic membrane embedded in the flow screen.

9. The system of claim 8 with the bulk metal in a holder on a side wall of the first replenisher compartment.

10. The system of claim 9 with the flow screen touching the holder and the inert cathode.

11. The system of claim 1 with the processor anionic membrane and the replenisher anionic membrane comprising the same membrane material.

12. An electroplating system comprising:

a processor having at least one electroplating vessel having a first processor compartment containing catholyte and a second processor compartment containing anolyte, with the anolyte separated from the catholyte by a substantially horizontal processor anionic membrane, and the catholyte including metal ions;

at least one inert anode in contact with the anolyte in the second processor compartment;

a head for holding a wafer substantially horizontal with a conductive seed layer in contact with the catholyte;

a contact ring on the head having electrical contacts for making electrical contact to the conductive seed layer;

a first electrical power supply connected to the at least one inert anode and to the conductive seed layer; and a replenisher including:

a first replenisher compartment connected to the first processor compartment via first supply and return lines, with the first replenisher compartment containing the catholyte and a holder holding bulk metal exposed to the catholyte;

a second replenisher compartment connected to the second processor compartment via second supply and return lines, with the second replenisher compartment containing the anolyte and an inert cathode on a vertical sidewall of the second replenisher compartment;

a substantially vertical replenisher anionic membrane separating the catholyte in the first replenisher compartment from the anolyte in the second replenisher compartment; and a second electrical power supply connected to the bulk metal and to the inert cathode.

13. The system of claim 12 wherein the bulk metal comprises copper and the anolyte comprises sulfate.

14. The system of claim 12 wherein the replenisher has only two replenisher compartments, with each compartment holding only one electrolyte.

15. The system of claim 12 further including a flow screen in the replenisher with the replenisher anionic membrane attached to the flow screen.

16. The system of claim 15 with the flow screen touching the holder and the inert cathode.

17. The system of claim 15 with the flow screen spaced apart from the inert cathode by 5 mm or less.

18. The system of claim 15 with the flow screen spaced apart from the bulk metal by 5 mm or less.

19. An electroplating system, comprising:

a processor including a first processor compartment containing a first electrolyte and a second processor compartment containing a second electrolyte, with the second electrolyte separated from the first electrolyte by a substantially horizontal processor anionic membrane; and a replenisher including a first replenisher compartment containing the first electrolyte and bulk metal exposed to the first electrolyte;

first supply and return lines from the first replenisher compartment to the first processor compartment;

a second replenisher compartment containing a second electrolyte, different from the first electrolyte, and an inert cathode in the second replenisher compartment;

second supply and return lines from the second replenisher compartment to the second processor compartment;

a substantially vertical replenisher anionic membrane separating the first electrolyte in the first replenisher compartment from the second electrolyte in the second replenisher compartment; and an electrical power supply connected to the bulk metal and to the inert cathode.

20. The replenisher of claim 19 with the vertical replenisher anionic membrane supported on a flow screen.

* * * * *